US007444954B1

(12) United States Patent
Resta

(10) Patent No.: US 7,444,954 B1
(45) Date of Patent: Nov. 4, 2008

(54) GANGPLANK SYSTEM FOR FACILITATING SAFE BOARDING AND DISEMBARKING FROM A BOAT

(76) Inventor: Stephen Resta, 3 Terrace Cir., Park Ridge, NJ (US) 07656

( * ) Notice: Subject to any disclaimer, the term of this patent is extended or adjusted under 35 U.S.C. 154(b) by 0 days.

(21) Appl. No.: 11/821,232

(22) Filed: Jun. 22, 2007

(51) Int. Cl.
*B63B 17/00* (2006.01)

(52) U.S. Cl. ..... 114/362

(58) Field of Classification Search ..... 114/343, 114/362; 14/71.1
See application file for complete search history.

(56) References Cited

U.S. PATENT DOCUMENTS 2,964,767 A * 12/1960 Egbert ..... 14/71.1
3,052,896 A 9/1962 Beach
3,285,367 A 11/1966 Brodie
3,869,742 A 3/1975 Gale et al.
4,011,615 A * 3/1977 Maxson et al. ..... 14/71.1
4,153,137 A 5/1979 Johnson
4,293,967 A * 10/1981 Ord ..... 114/362
4,365,689 A 12/1982 Dever
4,538,314 A * 9/1985 Baranowski ..... 114/362
5,586,516 A * 12/1996 Hagen et al. ..... 114/362
5,628,274 A * 5/1997 Biedenweg et al. ..... 114/362
6,021,733 A 2/2000 Jaramillo, Sr.
7,011,036 B1 * 3/2006 Hill ..... 114/362

* cited by examiner

*Primary Examiner*—Lars A Olson
(74) *Attorney, Agent, or Firm*—Richard L. Miller

(57) ABSTRACT

A gangplank system for facilitating safe boarding and disembarking from a boat which comprises a support structure attached to a deck of the boat. A mechanism is for stabilizing the support structure in a generally vertical position from a gunwale of the boat. The support structure is sized to extend and be adjusted in height above the gunwale of the boat. Another mechanism is for pivotally connecting a first end of a ramp assembly to the support structure above the gunwale of the boat. When the ramp assembly is adjusted for height and is pivoted outwardly away from the boat to a dock, a person can safely board and disembark from the boat.

22 Claims, 5 Drawing Sheets

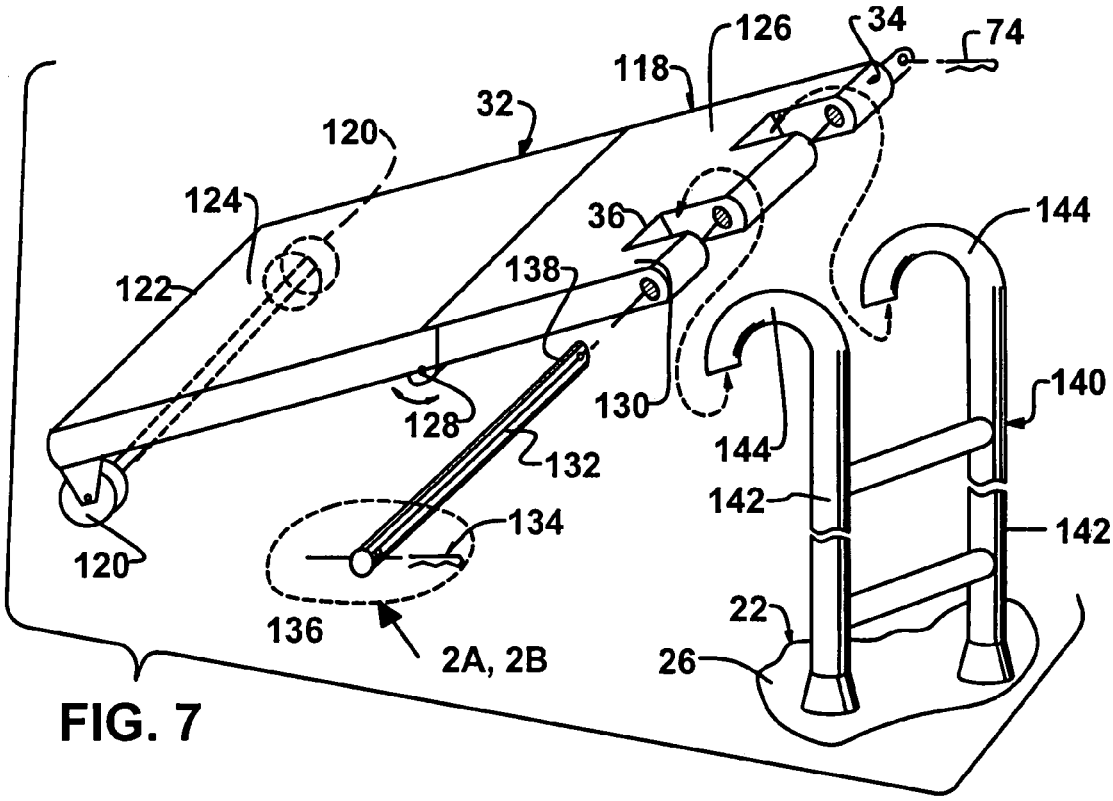
FIG. 7
FIG. 8
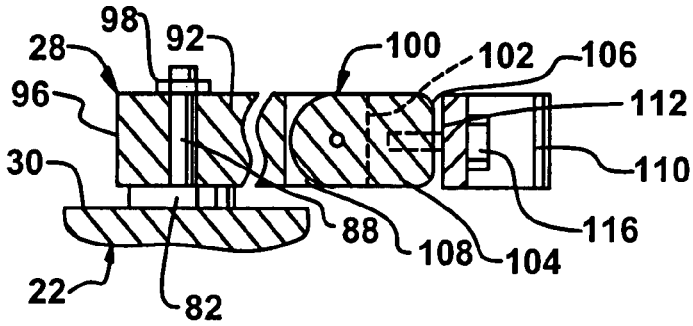

GANGPLANK SYSTEM FOR FACILITATING SAFE BOARDING AND DISEMBARKING FROM A BOAT

CROSS REFERENCE TO RELATED APPLICATIONS

The instant application contains subject matter disclosed in applicant's Disclosure Document No. 606957 filed on Oct. 2, 2006, and as such, it is respectfully requested in a separate paper attached herewith that this Disclosure Document be relied upon and remain a permanent part of the file history during the prosecution of the instant application and during any subsequent action thereof.

BACKGROUND OF THE INVENTION

1. Field of the Invention

The present invention relates to a boat ramp, and more particularly, a gangplank system for facilitating safe boarding and disembarking from a boat.

2. Description of the Prior Art

Numerous innovations for boat ladder devices have been provided in the prior art that will be described. Even though these innovations may be suitable for the specific individual purposes to which they address, however, they differ from the present invention.

A FIRST EXAMPLE, U.S. Pat. No. 3,052,896, Issued on Sep. 11, 1962, to Beach teaches a boat having a cockpit and a bow compartment located forward of the cockpit and in open communication therewith and with a bow deck covering the bow compartment. The bow deck has a transversely centered hatch opening connecting with the cockpit. A pair of doors are hinged to the bow deck at opposite sides of the hatch opening on fore and aft axes for movement between closed positions jointly covering the opening and open positions at the sides of the opening. A ladder is provided. A frame hinges the ladder to the boat on a transverse axis and transversely centered in the bow compartment for forward swinging movement of the ladder outwardly through the opening to a position depending from the bow of the boat. A windshield extends transversely across the rear portion of the bow desk and has its side ends directed rearwardly and pivoted to the boat on a common axis for raising the windshield rearwardly and upwardly about the common axis. When the doors are opened and the ladder is forward and the windshield is raised there is a clear path for passenger travel between the cockpit and the ladder.

A SECOND EXAMPLE, U.S. Pat. No. 3,285,367, Issued on Nov. 15, 1966, to Brodie teaches an emergency boat ladder assembly comprising a mounting bracket having a flat base portion adapted for attachment at a lower portion of a boat transom above water level. The bracket also includes lower and upper outwardly generally horizontally projecting portions. The lower projecting portion includes a pivot support mechanism adapted for connection with an upper end portion of a ladder to provide for swinging movement of the ladder in a vertical plane to a lower operative substantially vertically position and through approximately 180 degrees to an upper storage position adjacent and substantially parallel with the transom. The upper projecting portion includes a latch mechanism adapted for releasable connection with a ladder in its upper storage position. A ladder has a pair of vertical side rails and at least one horizontal rung connected therebetween at lower portions thereof. The ladder side rails being so spaced apart laterally as to receive the lower projecting portion at all times and to receive both the lower and the upper projecting portions of the mounting bracket therebetween when the ladder is swung to its upper storage position. The upper end portions of the side rails being pivotally connected with the lower projection portion on the bracket. The ladder being of such length that the rung thereon is disposed substantially beneath water level with the ladder in its lower operative position. The ladder being disposed beneath the upper edge of the transom and above the lower edge thereof when the ladder is in its upper or storage position.

A THIRD EXAMPLE, U.S. Pat. No. 3,869,742, Issued on Mar. 11, 1975, to Gale et al. teaches a single shaft ladder for use particularly by SCUBA divers in boarding small boats and a mounting bracket for mounting the ladder in angularly inclined relationship to the transom of a small boat with a top end portion of the ladder extending above and inwardly of the transom and with a bottom end portion extending in a downwardly divergent direction with respect to the transom into the water. The ladder has sets of opposite, laterally extending rungs spaced along the bottom portion of the ladder and a single rung extending laterally from one side of the upper portions of the ladder adjacent its top end to provide a handle for the person boarding the boat.

A FOURTH EXAMPLE, U.S. Pat. No. 4,153,137, Issued on May 8, 1979, to Johnson teaches a boat ladder which can be in the form of a complete ladder or a kit for mounting a ladder on a boat. The ladder preferably includes two or more ladder sections which can be readily connected and disassembled and easily stowed. Two mounting brackets are designed for use on a variety of gunwhales of boats. The lower section of the ladder has two threaded mounting pins which are adjustably held in the brackets to level the ladder and the pins can be easily separated from the mounting brackets when the ladder is not in use. The mounting pins are also pivoted so as to be swung out of the way along the rails of the ladder, when not in use.

A FIFTH EXAMPLE, U.S. Pat. No. 4,365,689, Issued on Dec. 28, 1982, to Dever teaches tiltable, portable, pivotable marine type ladder which is horizontally oriented in its normal position and tiltable to a vertical position by the application of an initial force in the vertical downward direction. The ladder having two parallel struts capable of being secured to a marine structure, such as a floating dock, and having counterweight balances at the top of two support members pivotably connected to the struts. When one exits the ladder, the slight movement of the water activates the ladder such that it reverts to its original horizontal position.

A SIXTH EXAMPLE, U.S. Pat. No. 6,021,733, Issued on Feb. 8, 200, to Jaramillo, Sr. teaches a retractable ladder assembly for a watercraft that has a rotatably mounted ladder which is attached to the craft by brackets. The ladder is pivotably mounted to the brackets. There is a plate biased to engage and rotatably retract the ladder from a user position to a storage position is also attached to the bracket. The bias is provided by a torsion spring. In one embodiment, the bracket mounts to the top of a rear platform of a boat and in another embodiment the ladder mounts to the underside of the rear platform of the boat. In both embodiments, the ladder may have a telescoping second ladder which retracts, due to gravity, when the torsion spring rotates the ladder assembly to a sufficient amount above the horizontal. There is also a stopper mechanism for each embodiment.

It is apparent now that numerous innovations for boat ladder devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a gangplank system for facilitating safe boarding and disembarking from a boat that avoids the disadvantages of the prior art.

ANOTHER OBJECT of the present invention is to provide a gangplank system for facilitating safe boarding and disembarking from a boat that is simple and inexpensive to manufacture.

STILL ANOTHER OBJECT of the present invention is to provide a gangplank system for facilitating safe boarding and disembarking from a boat that is simple to use.

BRIEFLY STATED, STILL YET ANOTHER OBJECT of the present invention is to provide a gangplank system for facilitating safe boarding and disembarking from a boat which comprises, a support structure attached to a deck of the boat. A mechanism is for stabilizing the support structure in a generally vertical position from a gunwale of the boat. The support structure is sized to extend in height above the gunwale of the boat. Another mechanism is for pivotally connecting a first end of a ramp assembly to the support structure above the gunwale of the boat. When the ramp assembly is pivoted outwardly away from the boat to a dock, and the ramp is adjusted for tide level and dock height a person can safely board and disembark from the boat.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 7 is a diagrammatic perspective view, with parts broken away, showing how a ladder can be removably attached to the ramp assembly;

FIG. 8 is an enlarged diagrammatic cross sectional view with parts broken away, taken on line 8-8 in FIG. 1.

A MARSHALING OF REFERENCE NUMERALS UTILIZED IN THE DRAWINGS

Figure 1:
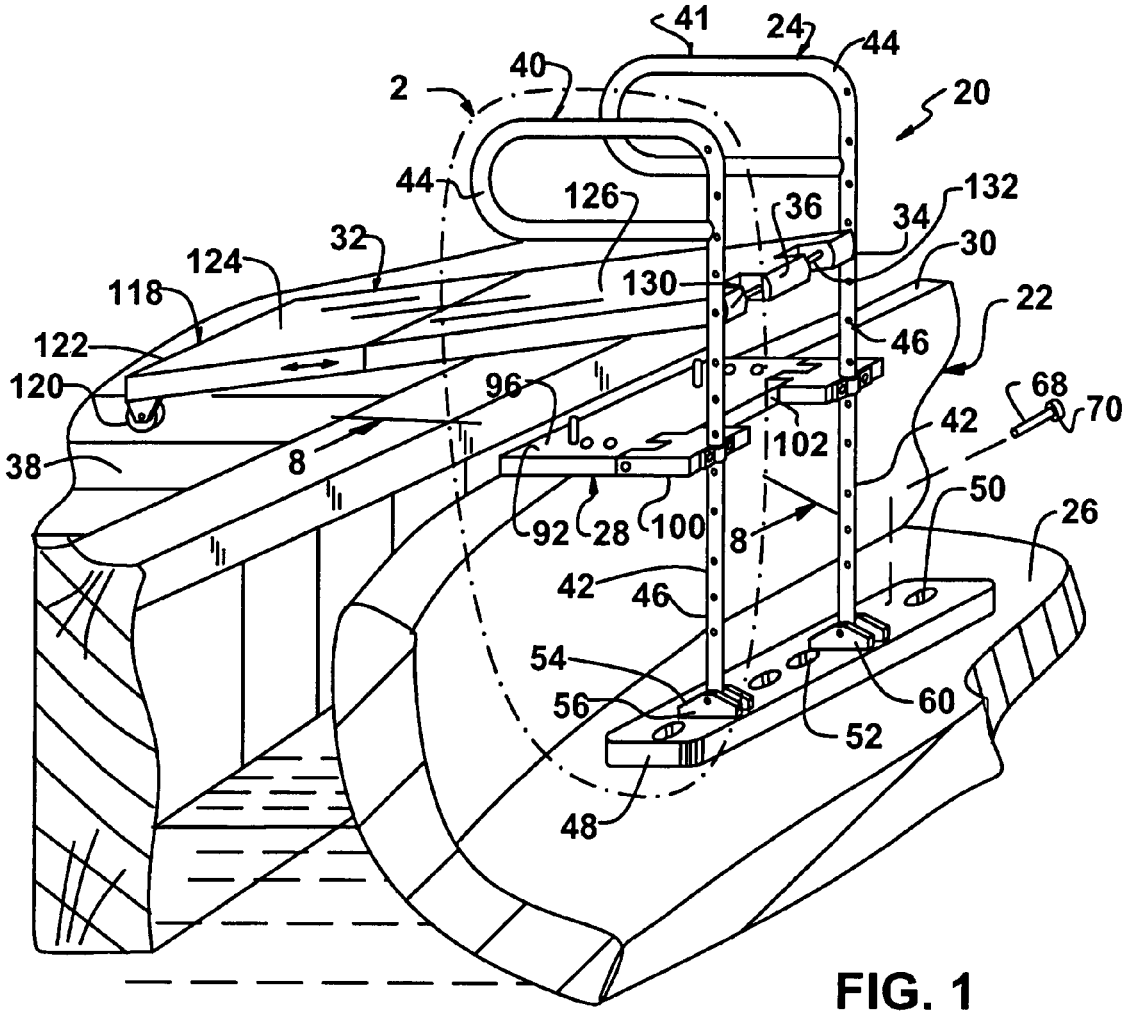
FIG. 1 is a diagrammatic perspective view, with parts broken away, showing a first embodiment of the present invention installed on a boat.

| FIRST EMBODIMENT | |
|---|---|
| 20 | gangplank system |
| 22 | boat |
| 24 | support structure of gangplank system 20 |
| 26 | deck of boat 22 |
| 28 | stabilizing mechanism of gangplank system 20 |
| 30 | gunwale of boat 22 |
| 32 | ramp assembly of gangplank system 20 |
| 34 | pivotally connecting mechanism of gangplank system 20 |
| 36 | first end of ramp assembly 32 |
| 38 | dock |
| 40 | first P-shaped stanchion of support structure 24 |
| 41 | second P-shaped stanchion of support structure 24 |
| 42 | upright portion of P-shaped stanchion 40, 41 |
| 44 | safety handle of P-shaped stanchion 40, 41 |
| 46 | aperture in P-shaped stanchion 40, 41 |
| 48 | base bracket of support structure 24 |
| 50 | hole in base bracket 48 |
| 52 | screw of support structure 24 |
| 54 | retaining mechanism of support structure 24 |
| 56 | first pair of ears of retaining mechanism 54 |
| 58 | holes in ears 56 |
| 60 | second pair of ears of retaining mechanism 54 |
| 62 | holes in ears 60 |
| 64 | first pivot pin of retaining mechanism 54 |
| 66 | enlarged head on first pivot pin 64 |
| 68 | second pivot pin of retaining mechanism 54 |
| 70 | enlarged head on second pivot pin 68 |
| 72 | locking mechanism of retaining mechanism 54 |
| 74 | hairpin cotter key for locking mechanism 72 |
| 76 | transverse hole in pivot pin 64, 68 |
| 78 | spring loaded ball for locking mechanism 72 |
| 80 | transverse bore in pivot pin 64, 68 |
| 82 | mounting plate of stabilizing mechanism 28 |
| 84 | hole in mounting plate 82 |
| 86 | screw for mounting plate 82 |
| 88 | mounting pin on mounting plate 82 |
| 90 | transverse aperture in mounting pin 88 |
| 92 | support platform of stabilizing mechanism 28 |
| 94 | aperture in support platform 92 |
| 96 | first edge of support platform 92 |
| 98 | hairpin cotter key of stabilizing mechanism 28 |
| 100 | clamp member of stabilizing mechanism 28 |
| 102 | second opposite edge of support platform 92 |
| 104 | bracket piece of clamp member 100 |
| 106 | C-shaped free edge of bracket piece 104 |
| 107 | threaded bore in C-shaped free edge 106 |
| 108 | hinge edge of bracket piece 104 |
| 110 | omega-shaped clamp of clamp member 100 |
| 112 | leg of omega-shaped clamp 110 |
| 114 | aperture in leg 112 |
| 116 | bolt of clamp member 100 |
| 118 | rectangular shaped board of ramp assembly 32 |
| 120 | wheel of ramp assembly 32 |
| 122 | second free end of rectangular shaped board 118 |
| 124 | first segment of rectangular shaped board 118 |
| 126 | second segment of rectangular shaped board 118 |
| 128 | hinge for first segment 124 and second segment 126 |
| 130 | knuckle of pivotally connecting mechanism 34 |
| 132 | elongated pin of pivotally connecting mechanism 34 |
| 134 | locking mechanism of pivotally connecting mechanism 34 |
| 136 | transverse aperture in elongated pin 132 |
| 138 | transverse bore in elongated pin 132 |
| 140 | ladder of gangplank system 20 |
| 142 | rail of ladder 140 |
| 144 | hook formed on an upper end of each rail 142 |

| SECOND EMBODIMENT | |
|---|---|
| 220 | gangplank system is for facilitating safe boarding and disembarking from a boat 222, or dock 38 |
| 222 | boat |
| 224 | support structure of gangplank system 220 |
| 226 | deck of boat 222 |
| 228 | attaching mechanism of gangplank system 220 |
| 230 | gunwale of the boat 222 |
| 232 | ramp assembly of gangplank system 220 |
| 234 | pivotally connecting mechanism of gangplank system 220 |
| 236 | first end of ramp assembly 232 |
| 238 | dock |
| 240 | first P-shaped stanchion of support structure 224 |
| 241 | second P-shaped stanchion of support structure 224 |
| 242 | upright portion of P-shaped stanchion 240, 241 |
| 244 | safety handle of P-shaped stanchion 240, 241 |
| 246 | aperture in P-shaped stanchion 240, 241 |
| 248 | dock bracket of attaching mechanism 228 |
| 250 | mounting hole in dock bracket 248 |
| 252 | boss on dock bracket 248 |
| 254 | intersecting aperture in boss 252 |
| 256 | bolt of attaching mechanism 228 |
| 258 | retaining pin of attaching mechanism 228 |
| 260 | enlarged head on retaining pin 258 |
| 262 | transverse hole in retaining pin 258 |
| 264 | hairpin cotter key of attaching mechanism 228 |
| 266 | rectangular shaped board of ramp assembly 232 |
| 268 | wheel of ramp assembly 232 |
| 270 | second free end of rectangular shaped board 266 |
| 272 | first segment of rectangular shaped board 266 |
| 274 | second segment of rectangular shaped board 266 |
| 276 | transverse elongated hole in first end 236 |
| 278 | elongated pivot pin of pivotally connecting mechanism 234 |
| 280 | enlarged head on elongated pivot pin 278 |
| 282 | transverse hole in elongated pivot pin 278 |
| 284 | hairpin cotter key of pivotally connecting mechanism 234 |

DETAILED DESCRIPTION OF THE PREFERRED EMBODIMENT

Figures 2, 2A, 2B, 3:
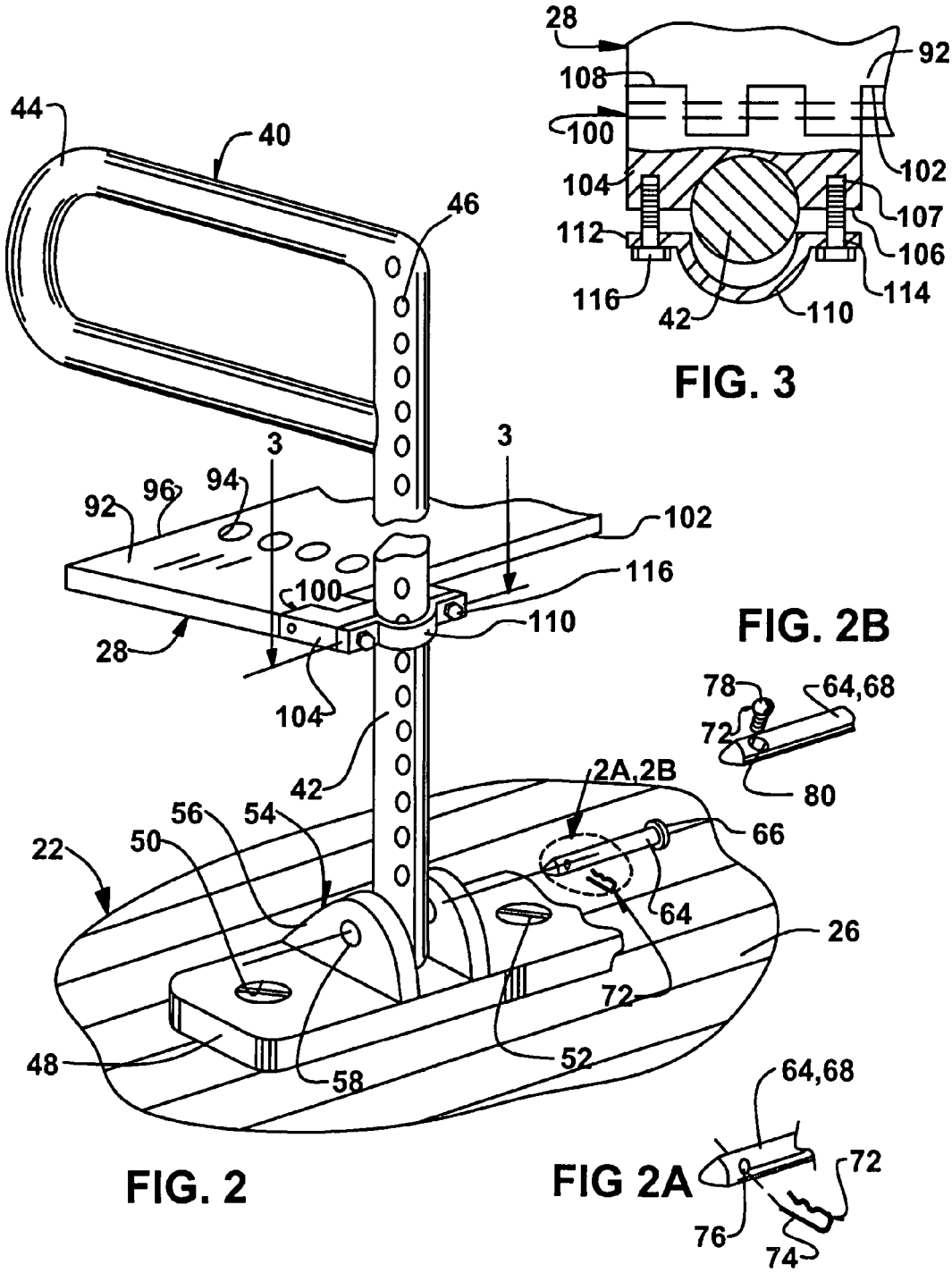
FIG. 2 is an enlarged diagrammatic perspective view, with parts broken away, of the area enclosed in the dotted curve indicated by arrow 2 in FIG. 1.
FIG. 2A is a further enlarged diagrammatic perspective view of the area enclosed in the dotted curve indicated by arrow 2A in FIGS. 2 and 7, showing how the cotter key is used to lock the pivot pin and the elongated pin in place.
FIG. 2B is a further enlarged diagrammatic perspective view of the area enclosed in the dotted curve indicated by arrow 2B in FIGS. 2 and 7, showing how a spring loaded ball is used to lock the pivot pin and the elongated pin in place.
FIG. 3 is an enlarged diagrammatic partial cross sectional view taken on line 3-3 in FIG. 2.
Figure 5:
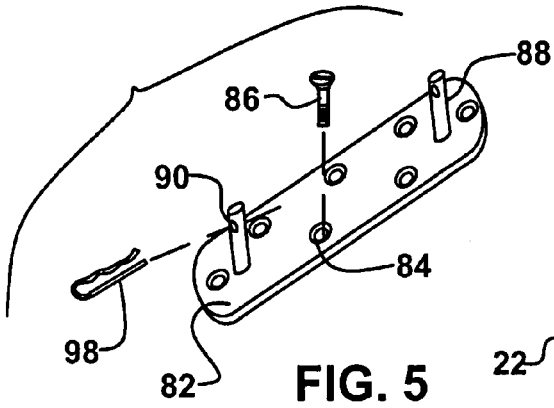
FIG. 5 is an enlarged diagrammatic perspective view showing the mounting plate with some of the associated hardware exploded therefrom.
Figure 4:
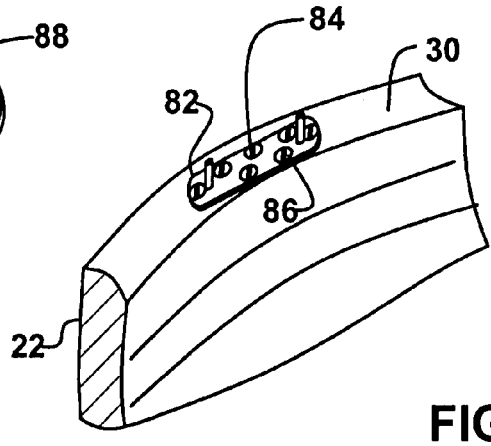
FIG. 4 is a diagrammatic perspective view, with parts broken away, of the gunwale of the boat showing the mounting plate attached thereon.
Figure 6:
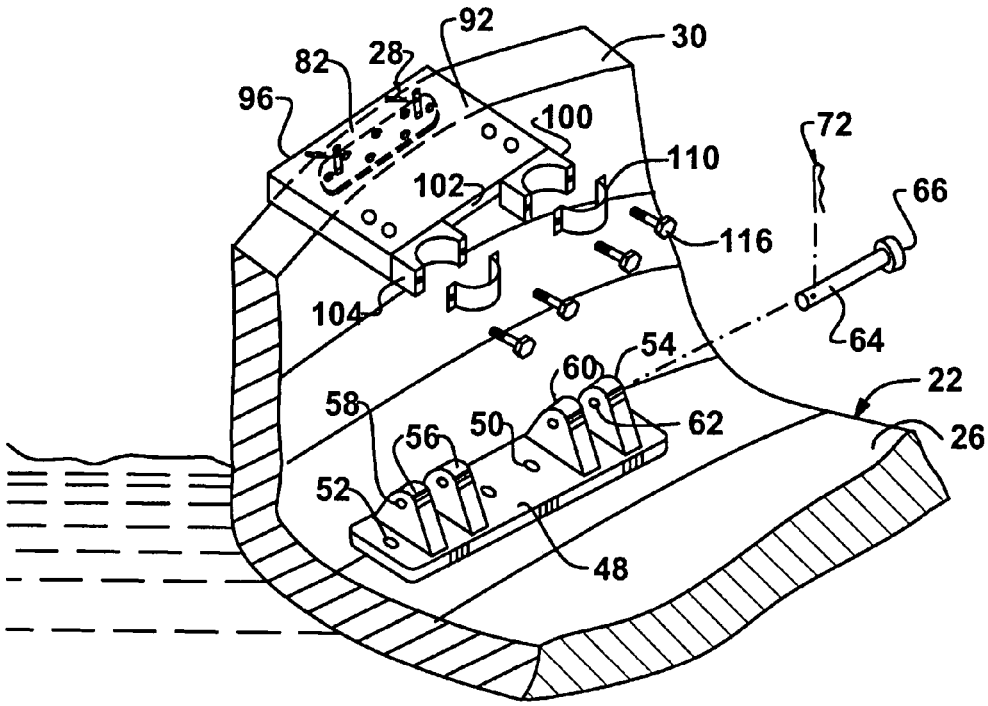
FIG. 6 is a diagrammatic perspective view of a portion of the boat, with parts broken away, showing the mounting components installed thereon.

Referring now to the figures, in which like numerals indicate like parts, and particularly to FIG. 1, which is a diagrammatic perspective view, with parts broken away, showing a first embodiment of the present invention installed on a boat; FIG. 2 which is an enlarged diagrammatic perspective view, with parts broken away of the area enclosed in the dotted curve indicated by arrow 2 in FIG. 1; FIG. 2A which is a further enlarged diagrammatic perspective view of the area enclosed in the dotted curve indicated by arrow 2A in FIGS. 2 and 7, showing how the cotter key is used to lock the pivot pin and the elongated pin in place; FIG. 2B which is a further enlarged diagrammatic perspective view of the area enclosed in the dotted curve indicated by arrow 2B in FIGS. 2 and 7, showing how a spring loaded ball is used to lock the pivot pin and the elongated pin in place; FIG. 3 which is an enlarged diagrammatic partial cross sectional view taken on line 3-3 in FIG. 2; FIG. 4 which is a diagrammatic perspective view, with parts broken away, of the gunwale of the boat showing the mounting plate attached thereon; FIG. 5 which is an enlarged diagrammatic perspective view showing the mounting plate with some of the associated hardware exploded therefrom; FIG. 6 which is a diagrammatic perspective view of the portion of the boat, with parts broken away, showing the mounting components installed thereon; FIG. 7 which is a diagrammatic perspective view, with parts broken away, showing how a ladder can be removably attached to the ramp assembly; and FIG. 8 which is an enlarged diagrammatic cross sectional view with parts broken away, taken on line 3-3 in FIG. 2; and as such, will be discussed with reference thereto.

The first embodiment of the present invention is a gangplank system 20 for facilitating safe boarding and disembarking from a boat 22 which comprises a support structure 24 attached to a deck 26 of the boat 22. A mechanism 28 is for stabilizing the support structure 24 in a generally vertical position from a gunwale 30 of the boat 22. The support structure 24 is sized to extend in height above the gunwale 38 of the boat 22. A ramp assembly 32 is provided. Another mechanism 34 is for pivotally connecting a first end 36 of the ramp assembly 32 to the support structure 24 above the gunwale 30 of the boat 22. When the ramp assembly 32 is adjusted to compensate for tide level and dock height and is pivoted outwardly away from the boat 22 to a dock 38, a person can safely board and disembark from the boat 22.

The support structure 24 comprises a pair of P-shaped stanchions 40, 41, each having an upright portion 42 and a safety handle 44 with a plurality of spaced apart apertures 46 therethrough. A base bracket 48 has a plurality of holes 50 therethrough. A plurality of screws 52 are provided to extend through the holes 50 in the base bracket 48 and into the deck 26 of the boat 22. A mechanism 54 is for retaining lower ends of the upright portions 42 of the pair of P-shaped stanchions 40, 41 in a spaced apart relationship to the base bracket 48.

The retaining mechanism 54 comprises a first pair of ears 56 having a first set of aligned holes 58. The first pair of ears 56 extend upwardly in a parallel relationship on the base bracket 48. A second pair of ears 60 have aligned holes 62. The second pair of ears 60 extend upwardly in a parallel relationship on base bracket 48 and are spaced away from the first pair of ears 56. A first pivot pin 64 has an enlarged head 66 on a first end, so that a second end of the first pivot pin 64 is insertable through the first set of aligned holes 58 in the first pair of ears 56 and the apertures 46 in the lower end of the upright portion 42 of the first P-shaped stanchion 40. A second pivot pin 68 has an enlarged head 70 on a first end, so that a second end of the second pivot pin 68 is insertable through the second set of aligned holes 62 in the second pair of ears 60 and the bottom apertures 46 in the lower end of the upright portion 42 of the second P-shaped stanchion 41. A mechanism 72 is for locking the first pivot pin 64 and the second pivot pin 68 in place.

Each locking mechanism 76, as best seen in FIG. 2A, comprises a hairpin cotter key 74 that is inserted through a transverse hole 76 in the second end of one of the pivot pins 64, 68. Each locking mechanism 72, as best seen in FIG. 2B, comprises a spring loaded ball 78 carried within a transverse bore 80 in the second end of each of pivot pins 64, 68.

The stabilizing mechanism 28 comprises a mounting plate 82 having a plurality of holes 84 therethrough. A plurality of screw 86 are provided to extend through the holes 84 in the mounting plate 82 and into the gunwale 30 of the boat 22. A pair of mounting pins 88 are spaced apart and affixed vertically upon the mounting plate 82. Each mounting pin 88 has a transverse aperture 90 in a free end. A support platform 92 has at least two spaced apart apertures 94 therethrough near a first edge 96 to receive the mounting pins 88. A pair of hairpin cotter keys 98 are provided which are each inserted through one transverse aperture 90 on the free end of each mounting pin 88 after the support platform 92 is adjusted into position upon the mounting plate 82. A pair of clamp members 100, are spaced apart and hinged to a second opposite edge 102 of the support platform 92 to engage with the upright portions 42 of the P-shaped stanchions 40, 41.

Each clamp member 100 comprises a bracket piece 104 hinged to the opposite second edge 102 of the support platform 92. The bracket piece 104 has a C-shaped free edge 106 with a pair of threaded bores 107 opposite from its hinge edge 108. An Omega-shaped clamp 110 has a pair of legs 112 with an aperture 114 through each leg 112. A pair of bolts 116 are provided, in which each bolt 116 is inserted through one aperture 114 in one leg 112 of one omega-shaped clamp 110 and into one threaded bore 107 to retain the upright portion 42 of each P-shaped stanchion 40, 41 between the C-shaped free edge 106 of the bracket piece 104 and the omega-shaped clamp 110 as best seen in FIG. 3.

The ramp assembly 32 comprises a rectangular shaped board 118 and a pair of wheels 120 rotatably attached near to a second free end 122 of the rectangular shaped board 118, to make contact and ridge upon the dock 38.

The rectangular shaped board 118 is divided into two segments 124, 126. The two segments 124, 126 of the rectangular shaped board 118 are telescopically connected together, so as to be extendible and compressible, as shown in FIG. 1. The two segments 124, 126 of the rectangular shaped board 118 can also be hinged together at 128, so as to be folded or extended, as shown in FIG. 7.

The pivotally connecting mechanism 34 comprises the ramp assembly 32 having a plurality of knuckles 130 along the first end 36. An elongated pin 132 extends through the knuckles 130 on the first end 36 of the ramp assembly 32. A mechanism 134 is for locking the elongated pin 132 in place within the knuckles 130 on the first end 36 of the ramp assembly 32 and two aligned apertures 46 in the P-shaped stanchions 40, 41.

The locking mechanism 134 comprises a pair of hairpin cotter keys 74, as shown in FIG. 2A. Each hairpin cotter key 74 is inserted through a transverse aperture 136 in one end of the elongated pin 132. The locking mechanism 94 can also comprise a pair of spring loaded balls 78, as shown in FIG. 2B. Each spring loaded ball 78 is carried within a transverse bore 138 in one end of the elongated pin 132. The gangplank system 20, as shown in FIGS. 1 and 7, further comprises a ladder 140 having a pair of rails 142 with a hook 144 formed on an upper end of each rail 142 to engage with the elongated pin 132 between the knuckles 130. Lower ends of the rails 142 of the ladder 140 rest on the deck 26 or flat horizontal surface of the boat 22, so that a person can use the ladder 140 to easily reach the ramp assembly 32 when it is adjusted at a higher level.

Figure 9:
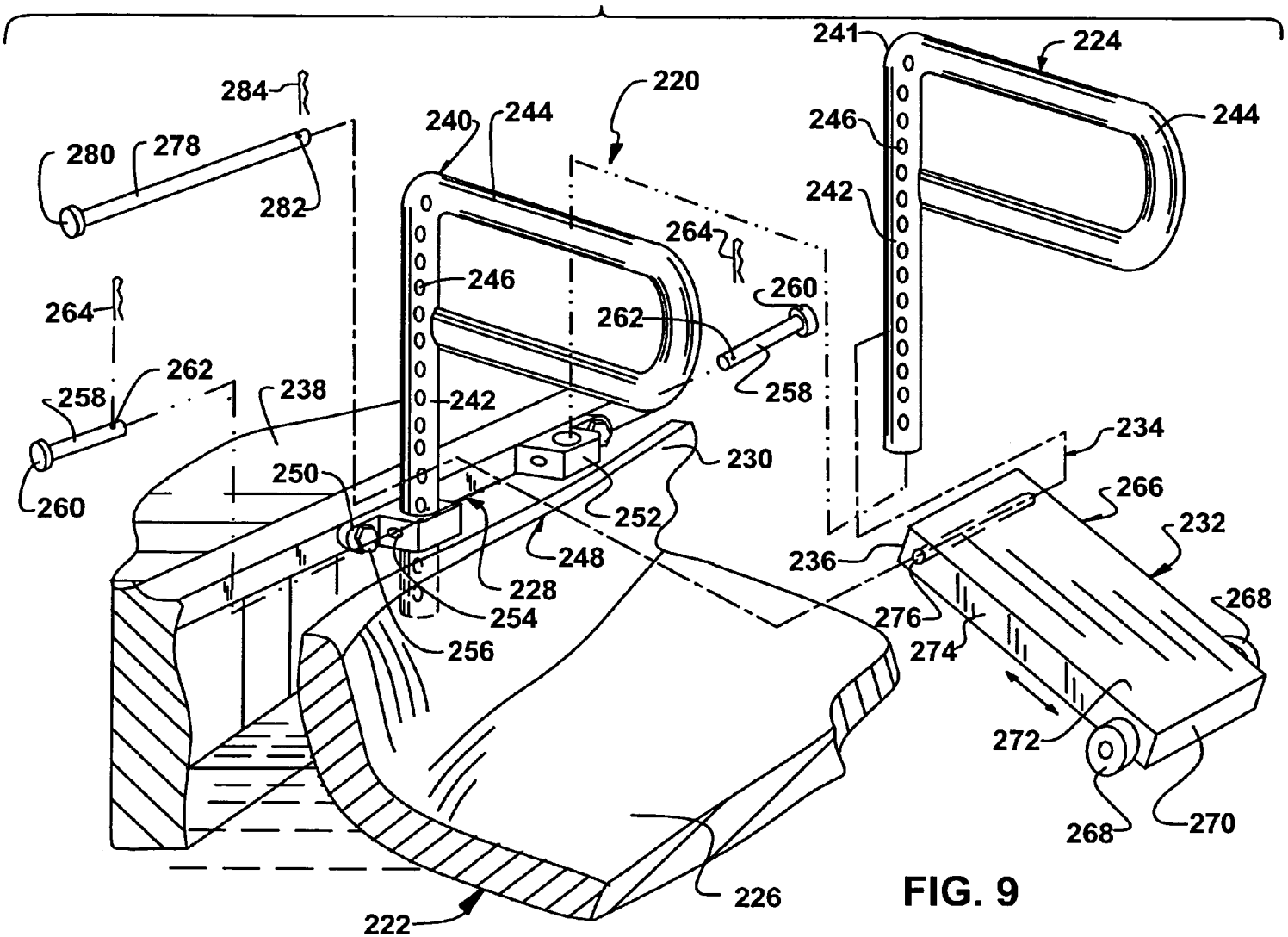
FIG. 9 is a partially exploded diagrammatic perspective view showing a second embodiment of the invention installed to a dock.

FIG. 9 is a partially exploded diagrammatic perspective view showing a second embodiment of the invention installed to a dock, and as such, will be discussed with reference thereto. A gangplank system 220 is for facilitating safe boarding and disembarking from a boat 222 which comprises a support structure 224. A mechanism 228 is for attaching the support structure 224 to a forward top edge of a dock 238 adjacent to a gunwale 230 of the boat 222. A ramp assembly 232 is provided. Another mechanism 234 is for pivotally connecting a first end 236 of the ramp assembly 232 to the support structure 224 above the gunwale 230 of the boat 222. When the ramp assembly 232 is pivoted outwardly away from the dock 238 over the gunwale 230 to a deck 226 of the boat 222 and adjusted to tide and gunwale height, a person can safely board and disembark from the boat 222.

The support structure 224 comprises a pair of P-shaped stanchions 240, 241, each having an upright portion 242 and a safety handle 244, with a plurality of spaced apart apertures 246 therethrough.

The attaching mechanism 228 comprises a dock bracket 248 having a plurality of mounting holes 250 therethrough and a pair of spaced apart bosses 252 with intersecting apertures 254. A plurality of bolts 256 extend through the mounting holes 250 in said dock bracket 248 and into the forward top edge of the dock 238. A pair of retaining pins 258 are provided. Each retaining pin 258 has an enlarged head 260 on a first end and a transverse hole 262 on a second end. Each retaining pin 258 is insertable through one intersecting aperture 254 in the boss 252 in the docket bracket 248 and through a matching aperture 246 as adjusted in the upright portion 242 of P-shaped stanchions 240, 241. A pair of hairpin cotter keys 264 are also provided, which are each inserted through a transverse hole 262 on the second end of the retaining pins 258.

The ramp assembly 232 comprises a rectangular shaped board 266. A pair of wheels 268 are rotatably attached near to a second free end 270 of the rectangular shaped board 266, to make contact and ridge upon the deck 226 of the boat 222. The rectangular shaped board is divided into two segments 272, 274. The two segments 272, 274 of the rectangular shaped board 226 are telescopically connected together, so as to be extensible and compressible.

The pivotally connecting mechanism 234 comprises the first end 236 of the ramp assembly 232 having an elongated transverse hole 276 therethrough. An elongated pivot pin 278 has an enlarged head 280 on a first end and a transverse hole 282 on a second end. The elongated pivot pin 278 is insertable through the elongated transverse hole 276 in the first end 236 of the ramp assembly 232. A hairpin cotter key 284 is inserted through the transverse hole 282 on the second end of the elongated pivot pin 278, after the elongated pivot pin 278 is inserted through matching apertures 246 in the pair of P-shaped stanchions 240, 241 and the elongated transverse hole 276 in the first end 236 of the ramp assembly 232 to hold the ramp assembly 232 in a pivotable position to the P-shaped stanchions 240, 241.

It will be understood that each of the elements described above, or two or more together, may also find a useful application in other types of constructions differing from the types described above.

While the invention has been illustrated and described as embodiments of a ramp system for facilitating safe boarding and disembarking from a boat, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A gangplank system for facilitating safe boarding and disembarking from a boat which comprises:

a) a support structure attached to a deck of the boat;

b) means for stabilizing said support structure in a generally vertical position from a gunwale of the boat, wherein said support structure is sized to extend to be adjusted in height above the gunwale of the boat;

c) a ramp assembly; and d) means for pivotally connecting a first end of said ramp assembly to said support structure at or above the gunwale of the boat, so that when said ramp assembly is pivoted outwardly away from the boat to a dock, a person can safely board and disembark from the boat.

2. The gangplank system as recited in claim 1, wherein said support structure comprises:

a) a pair of P-shaped stanchions, each having an upright portion and a safety handle with a plurality of spaced apart apertures therethrough;

b) a base bracket having a plurality of holes therethrough;

c) a plurality of screws to extend through the holes in said base bracket and into the deck of the boat; and d) means for retaining lower ends of the upright portions of said pair of P-shaped stanchions in a spaced apart relationship to said base bracket.

3. The gangplank system as recited in claim 2, wherein said retaining means comprises:

a) a first pair of ears having a first set of aligned holes, said first pair of ears extending upwardly in a parallel relationship on said base bracket;

b) a second pair of ears having aligned holes, said second pair of ears extending upwardly in a parallel relationship on said base bracket and spaced away from said first pair of ears;

c) a first pivot pin having an enlarged head on a first end, so that a second end of said first pivot pin is insertable through said first set of aligned holes in said first pair of ears and the apertures in the lower end of said upright portion of said first P-shaped stanchion;

d) a second pivot pin having an enlarged head on a first end, so that a second end of said second pivot pin is insertable through said second set of aligned holes in said second pair of ears and the apertures in the lower end of said upright portion of said second P-shaped stanchion; and e) means for locking said first pivot pin and said second pivot pin in place.

4. The gangplank system as recited in claim 3, wherein each said locking means comprises a hairpin cotter key, that is inserted through a transverse hole in the second end of one of said pivot pins.

5. The gangplank system as recited in claim 3, wherein each said locking means comprises a spring loaded ball carried within a transverse bore in the second end of one of said pivot pins.

6. The gangplank system as recited in claim 2, wherein said stabilizing means comprises:

a) a mounting plate having a plurality of holes therethrough;

b) a plurality of screws to extend through the holes in said mounting plate and into the gunwale of the boat;

c) a pair of mounting pins spaced apart and affixed vertically upon said mounting plate, each said mounting pin having a transverse aperture in a free end;

d) a support platform having at least three spaced apart apertures therethrough near a first edge to receive said mounting pins;

e) a pair of hairpin cotter keys which are each inserted through one transverse aperture on the free end of each said mounting pin after said support platform is placed in position upon said mounting plate; and f) a pair of clamp members, spaced apart and hinged to a second opposite edge of said support platform to engage with the upright portions of said P-shaped stanchions.

7. The gangplank system as recited in claim 6, wherein each said clamp member comprises:

a) a bracket piece hinged to the opposite second edge of said support platform, said bracket piece having a C-shaped free edge with a pair of threaded bores opposite from its hinged edge;

b) an omega-shaped clamp having a pair of legs with an aperture through each leg; and c) a pair of bolts, in which each said bolt is inserted through one aperture in one leg of one said omega-shaped clamp and into the threaded bore to retain the upright portion of one said P-shaped stanchion between the C-shaped free edge of said bracket piece and said omega-shaped clamp.

8. The gangplank system as recited in claim 2, wherein said ramp assembly comprises:

a) a rectangular shaped board; and b) a pair of wheels rotatably attached near to a second free end of said rectangular shaped board, to make contact and ridge upon the dock.

9. The gangplank system as recited in claim 8, wherein said rectangular shaped board is divided into two segments.

10. The gangplank system as recited in claim 9, wherein said two segments of said rectangular shaped board are telescopically connected together, so as to be extendible and compressible.

11. The gangplank system as recited in claim 9, wherein said two segments of said rectangular shaped board are hinged together, so as to be folded or extended.

12. The gangplank system as recited in claim 2, wherein said pivotally connecting means comprises:

a) said ramp assembly having a plurality of knuckles along the first end;

b) an elongated pin extending through said knuckles on the first end of said ramp assembly; and c) means for locking said elongated pin in place within said knuckles on the first end of said ramp assembly and two aligned apertures in said P-shaped stanchions.

13. The gangplank system as recited in claim 12, wherein said locking means comprises a pair of hairpin cotter keys, in which each said hairpin cotter key is inserted through a transverse aperture in one end of said elongated pin.

14. The gangplank system as recited in claim 12, wherein said locking means comprises a pair of spring loaded balls, in which each said spring loaded ball is carried within a transverse bore in one end of said elongated pin.

15. The gangplank system as recited in claim 12, further comprising a ladder having a pair of rails with a hook formed on an upper end of each said rail to engage with said elongated pin between said knuckles, with lower ends of said rails of said ladder resting on the deck of the boat, so that a person can use said ladder to easily reach said ramp assembly when ramp is in a higher adjusted position.

16. A gangplank system for facilitating safe boarding and disembarking from a boat which comprises:

a) a support structure:

b) means for attaching said support structure to a forward top edge of a dock adjacent to a gunwale of the boat so as to be able to be adjusted to tidal height change and gunwale height;

c) a ramp assembly; and d) means for pivotally connecting a first end of said ramp assembly to said support structure above the gunwale of the boat, so that when said ramp assembly is pivoted outwardly away from the dock over the gunwale to a deck of the boat, a person can safely board and disembark from the boat.

17. The gangplank system as recited in claim 16, wherein said support structure comprises a pair of P-shaped stanchions, each having an upright portion and a safety handle, with a plurality of spaced apart apertures therethrough.

18. The gangplank system as recited in claim 17, wherein said attaching means comprises:

a) a dock bracket having a plurality of mounting holes therethrough and a pair of spaced apart bosses with intersecting apertures;

b) a plurality of bolts to extend through the mounting holes in said dock bracket and into the forward top edge of the dock;

c) a pair of retaining pins, with each said retaining pin having an enlarged head on a first end and a transverse hole on a second end, so that each said retaining pin is insertable through one intersecting aperture in the boss in said dock bracket and through a matching aperture in said upright portion of one said P-shaped stanchion; and d) a pair of hairpin cotter keys, which are each inserted through a transverse hole on the second end of one said retaining pin.

19. The gangplank system as recited in claim 18, wherein said ramp assembly comprises:

a) a rectangular shaped board; and b) a pair of wheels rotatably attached near to a second free end of said rectangular shaped board, to make contact and ride upon the deck of the boat.

20. The gangplank system as recited in claim 19, wherein said rectangular shaped board is divided into two segments.

21. The gangplank system as recited in claim 20, wherein said two segments of said rectangular shaped board are telescopically connected together, so as to be extensible and compressible.

22. The gangplank system as recited in claim 21, wherein said pivotally connecting means comprises:

a) said first end of said ramp assembly having an elongated transverse hole therethrough;

b) an elongated pivot pin having an enlarged head on a first end and a transverse hole on a second end, so that said elongated pivot pin is insertable through the elongated transverse hole in said first end of said ramp assembly; and c) a hairpin cotter key inserted through the transverse hole on the second end of said elongated pivot pin after said elongated pivot pin is inserted through matching apertures in said pair of P-shaped stanchions and the elongated transverse hole in said first end of said ramp assembly to hold said ramp assembly in a pivotable position to said P-shaped stanchions.

* * * * *